US005301380A

United States Patent [19]

Wadman et al.

[11] Patent Number: 5,301,380

[45] Date of Patent: Apr. 12, 1994

[54] CLEANING APPARATUS FOR SUBMERGED SURFACES

[75] Inventors: Alexis A. F. Wadman, Bedfordview; Hendrikus J. van der Meyden, Edenvale, both of South Africa

[73] Assignee: Cleave Corporation, Tortola, British Virgin Isls.

[21] Appl. No.: 963,103

[22] Filed: Oct. 19, 1992

[30] Foreign Application Priority Data

| | | | |
|---|---|---|---|
| Oct. 18, 1991 | [GB] | United Kingdom | 9122153 |
| Jun. 11, 1992 | [ZA] | South Africa | 92/4264 |
| Jun. 22, 1992 | [ZA] | South Africa | 92/4575 |

[51] Int. Cl.[5] ..... E04H 3/20

[52] U.S. Cl. ..... 15/1.7; 15/404

[58] Field of Search ..... 15/1.7, 404

[56] References Cited

U.S. PATENT DOCUMENTS

| | | | |
|---|---|---|---|
| 4,023,227 | 5/1977 | Chauvier | 15/1.7 |
| 4,208,752 | 6/1980 | Hofmann | 15/1.7 |
| 4,642,833 | 2/1987 | Stoltz et al. | 15/1.7 |
| 4,817,225 | 4/1989 | Stoltz | 15/1.7 |
| 5,033,148 | 7/1980 | Chauvier | 15/1.7 |

FOREIGN PATENT DOCUMENTS 0205697 12/1986 European Pat. Off. .

*Primary Examiner*—Edward L. Roberts

*Attorney, Agent, or Firm*—Jones, Day, Reavis & Pogue

[57] ABSTRACT

A pool cleaner (1) has a suction head (2) with a flow interrupter having a ball (12) movable to interrupt a primary liquid flow through the suction head and a release means (16) is located downstream of the ball (12) and has a flow passage allowing an auxiliary liquid flow into the tube when the ball interrupts the primary liquid flow. The auxiliary flow abruptly dislodges the ball and allows primary liquid flow.

26 Claims, 4 Drawing Sheets

CLEANING APPARATUS FOR SUBMERGED SURFACES

INTRODUCTION

This invention relates to cleaning apparatus for submerged surfaces.

BACKGROUND TO THE INVENTION

Such submerged surfaces are typically the underwater surfaces of a swimming pool, and automatic swimming pool cleaners are well known. Most automatic pool cleaners operate by interrupting the flow of water in a tube flowing through a hose to the pool filter pump. The flow is interrupted at a relatively high frequency in order to induce movement in the suction head of the pool cleaner by the abrupt cutting off of the flow of water being sucked up the tube and hose.

The suction head is thus moved over the surface of the pool to clean it. The mechanism used for interrupting the flow, varies from cleaner to cleaner, and it is this mechanism which can be crucial to the success of the cleaner. There must be a sufficient opening time, and size of opening, to allow debris such as leaves and the like to flow through, and the interruption must be of a sufficient frequency and speed to provide suitable movement.

OBJECT OF THE INVENTION

It is an object of this invention to provide cleaning apparatus arranged to clean a submerged surface.

SUMMARY OF THE INVENTION

In accordance with this invention, there is provided a cleaning apparatus arranged to clean a submerged surface, comprising a suction head with a liquid entrance which is locatable against the surface, and which is in communication with a tube projecting away from the entrance with its free end connectable to a suction hose, the suction head also having a flow interrupter with a closure member movable to periodically and abruptly interrupt a primary liquid flow in use from the suction entrance through the tube to the hose, thereby to cause the suction head to move along the surface in suction communication therewith, and clean the surface, characterised in that:

a release means is located downstream of the closure member in the primary flow path of the tube, and has at least one liquid flow passage allowing an auxiliary liquid flow into the tube when the closure member interrupts the primary liquid flow, the flow passage being shaped to direct such auxiliary liquid flow in use to cause a force to operate on the closure member to thereby dislodge it and allow the primary liquid flow.

The invention can be further characterised in that the cross sectional flow area of the auxiliary flow passage and the primary liquid flow passage, together with the shaping of the auxiliary flow passage, are balanced to prevent excessive liquid flow through the auxiliary flow passage when the primary liquid flow occurs in use.

Preferably openings for the auxiliary flow have a flow control means which is movable from a rest position in response to increasing auxiliary flow pressure, to increase the cross sectional area of the auxiliary flow path into the auxiliary flow openings, and which is movable to return to the rest position with decrease in auxiliary flow pressure.

Further preferably the release means is located around the tube, and includes a throat wall around auxiliary flow openings in the tube, the wall defining an annular throat leading into the auxiliary flow openings in the tube.

There is provided for the auxiliary flow openings in the tube to be formed by four axially extending slots spaced equally around the circumference of the tube, and for the flow control means to be a resilient skirt extending in operative location radially inwardly from the throat wall, across the throat opening, and extending further axially around the tube towards the head.

The axially directed portion forms a skirt which tapers from a widest position removed from the tube wall and spaced from the tube openings, to a narrower free end position in which the free end of the skirt is around the tube openings and adjacent the tube walls.

A particular feature of the invention provides for the auxiliary flow passage to be dimensioned and shaped to allow the auxiliary flow in use to abruptly dislodge the closure member in use, and cause the closure member to move away from its interruption position and strike a rebound surface in the suction head.

Preferably the closure member is a ball and the ball is movable to seat against a round throat in the suction entrance to thereby interrupt the primary liquid flow, and the rebound surface is located at the end of the cage opposite the throat.

The rebound surface is shaped to direct the ball back to the throat surface after the ball has struck it, and preferably has a convex shape.

There is also provided for the tube to extend into the suction head to be axially rotatable in a sealed mounting where it enters the suction head.

The throat wall preferably has a concentric tubular stem threadedly engagable around a complementarily threaded end of the main flow tube from the cleaning head, which stem is securable by means of a threaded collar acting as a lock nut at the end of the stem.

In this case, a tube section passing through the release means and carrying the auxiliary flow openings, is threadedly securable within the tubular stem to be concentric with the main flow tube.

There is further provided for the said release means tube section to carry a blind throat portion which is complementarily shaped to the throat portion leading to the tube openings, and which is spaced apart from the throat wall by spacer blocks. The spacer blocks are spaced apart around the circumference of the abutting throat wall and blind throat portions, leaving openings in between spacer blocks which communicate with the throat.

Preferably, the blocks are carried on a ring which is resilient and has radial formations clippable onto complementary radial formations around the outside of the throat wall and the blind throat portion, and the blocks are of resilient material, selected to provide a locking action under compression when the threaded parts are connected.

An additional feature of the invention is an adjustable weight, locatable in selectable positions between the suction head and the free tube end, and spaced from the plane of operation of the suction head against the surface in use.

The adjustable weight is located on that side of the body which has generally the smallest angular distance from the operative plane of the suction head and hence the surface to be cleaned in use, and the weight is slidable along a path in at least one guide and includes securing means for securing it in association with the tube and suction head.

Preferably the securing means is a screw extending through the weight to be engagable with one of a plurality of flutes located along the path at spaced intervals.

BRIEF DESCRIPTION OF THE DRAWINGS

Preferred embodiments of the invention are described below by way of example only, and with reference to the accompanying drawings, in which.

DETAILED DESCRIPTION OF THE DRAWINGS

Figure 1:
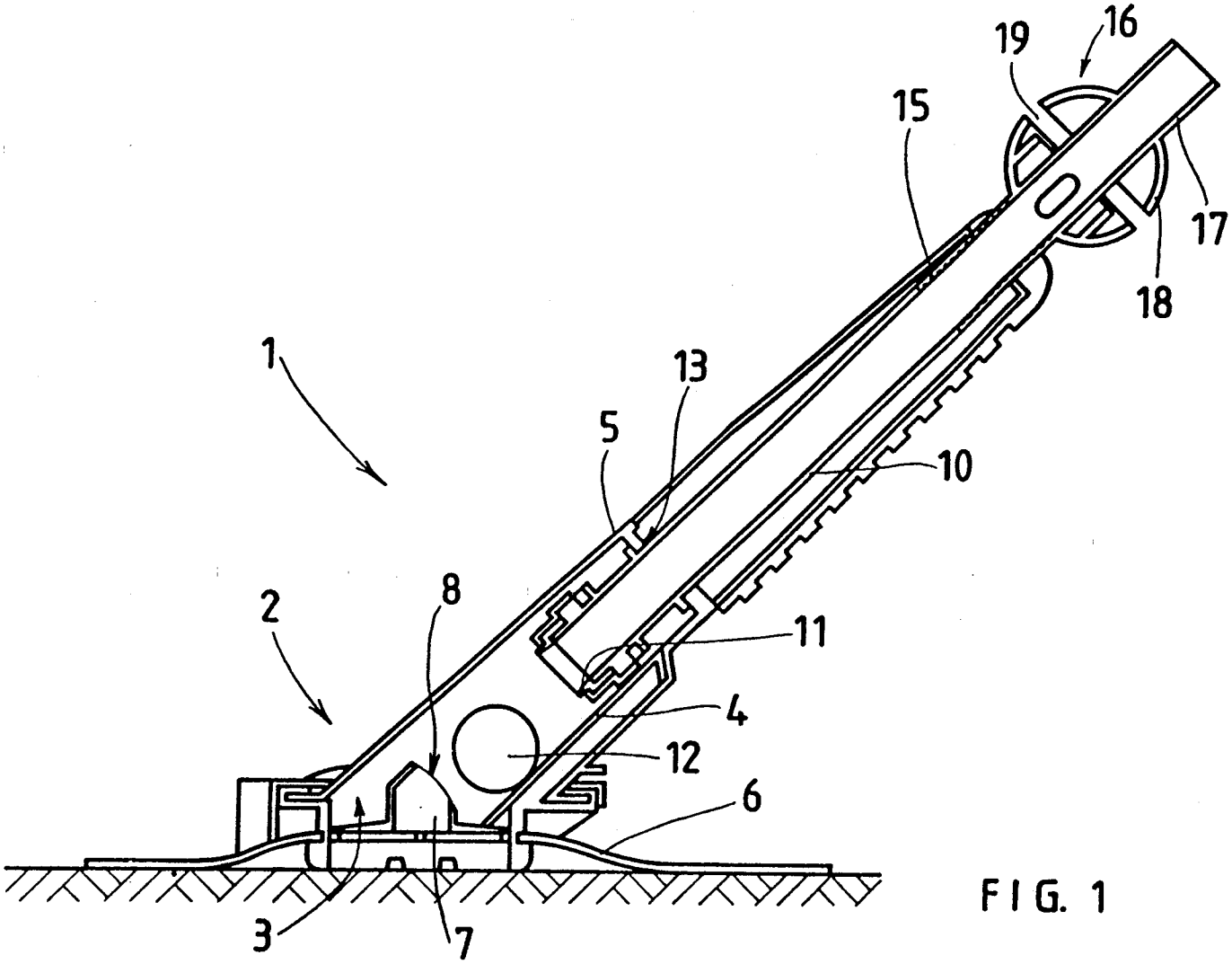
FIG. 1 is a cross-sectional view of apparatus according to the invention.
Figure 2:
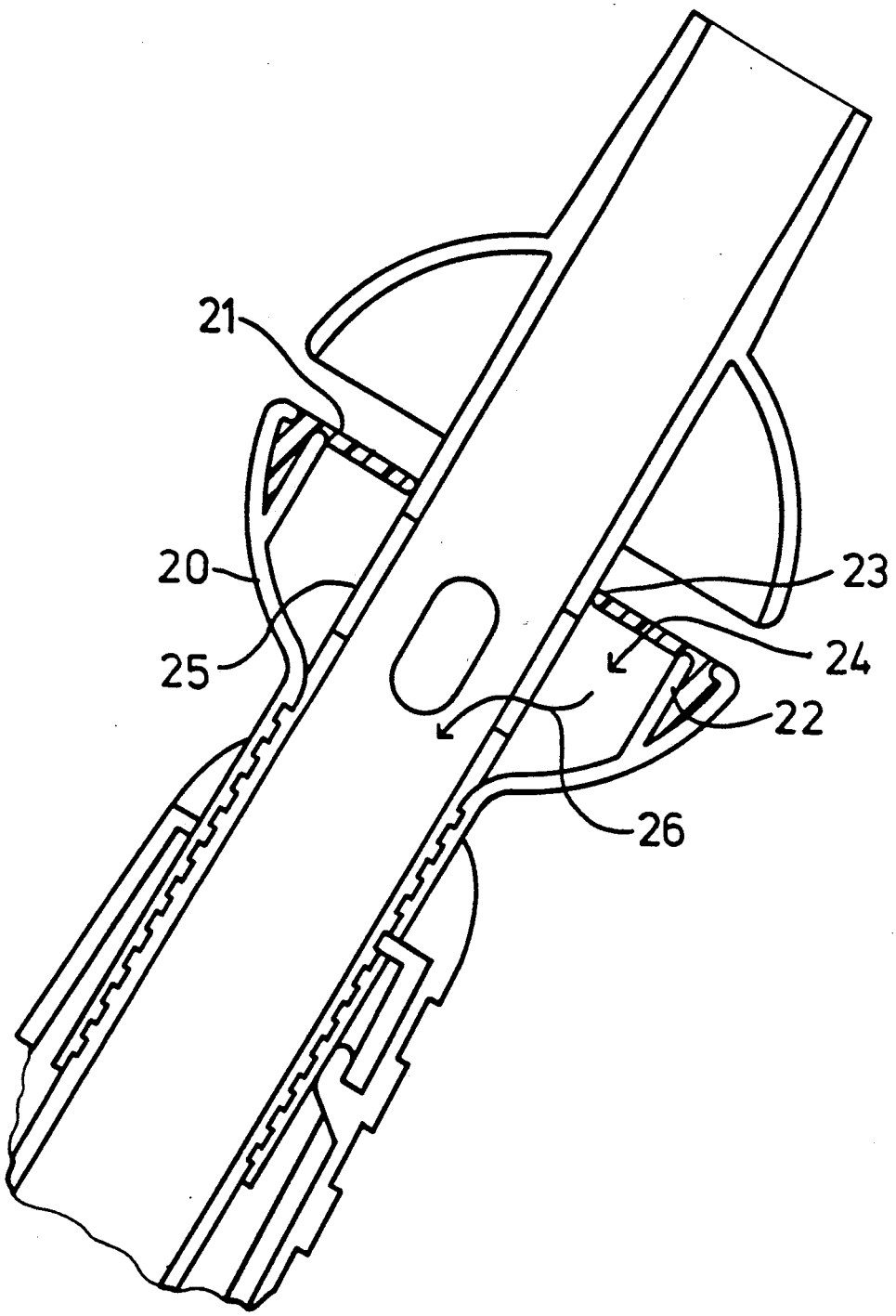
FIG. 2 is an enlarged cross-sectional view of a first embodiment of a release means, shown in FIG. 1.

Referring to FIGS. 1 and 2, a swimming pool cleaner (1) comprises a suction head (2) having a liquid entrance (3) at its operatively lowermost end, and a tubular body (4) leading away therefrom to an operatively upper end (5). A flexible pad (6) surrounds the entrance (3) to assist the suction head to be secured against the surface to be cleaned, by means of suction from water pumped through the entrance (3) and out of the upper end (5). At the centre of the suction entrance is located a rebound hub (7) secured in position by radial supports. The rebound hub has a rebound surface (8) facing the upper end (5) of the suction head.

A suction tube (10) extends into the upper end (5) of the body (4), and has a suction throat (11) at its interior end. A closure member (12) in the form of a ball is located within the body (4) of the suction head, between the rebound surfaces (8) and the suction throat (11).

At the upper end (5) of the suction head, where the tube enters the head, is a joint (13). This joint enables the tube (10) to swivel axially within the suction head, and if necessary rotate through 360° or more. The suction tube (10) extends away from the suction head to an upper end (15) where it is joined to a release means (16).

The release means has an inner tube (17) co-axial with the tube (10), and which is surrounded by two hollow hemispherical shields (18) which are spaced apart from each other in the length of the tube section (17), to leave an annular gap (19) between the voids of the two shells.

The shell (20) (FIG. 2) which is nearest the tube (10), has a flexible annular skirt (21) extending from retaining formations (22) at the outer periphery of the shell, radially inwardly to abut the wall of the tube section (17) at position (23). The skirt is flexible and can be resiliently deflected into the shell, to open up a passageway which enters radially into the gap (19), and turns axially toward the suction head, as indicated by arrow (24).

Located within the shell (20) and in the periphery of the tube section (17), are openings (25) spaced apart around the tube section. This enables the path (24) to continue from the interior of the shell through the openings (25) and axially into the tube section (17) towards the suction head, as indicated by arrow (26). The other shell (18) is primarily for aesthetic appearances, and to house a float.

In use, with the suction head submerged and the upper end of the release means connected by a suction hose (not shown) to a pool filter pump, the cleaner is ready for operation. The pool filter pumps water in a primary water flow through the entrance (3) into the suction head and along the hose. This causes the closure member (12) to be sucked up against the suction throat (11), which will immediately interrupt the water flow and cause an impulse to be transmitted to the suction head through the cessation of the flow.

This imparts movement to the cleaner head, as is known in the art per se. In order to release the ball the release means (16) is provided. When the ball (12) is held against the suction throat (11), auxiliary water flow is sucked in past the skirt (21) through the gap (19) along path (24), and is directed downwardly towards the suction head through the openings (25), along the path (26).

Whilst there may be little or no auxiliary water flow down the tube, the flow direction has the effect of releasing the pressure on the closure member, and providing an impulsive force down the water in the tube (10) to release the ball (12).

The ball (12) is released abruptly and shoots down the length of the suction head towards the rebound surface (8). The ball strikes the rebound surface and is directed by the flat surface back towards the suction throat (11). A convex surface can sometimes be advantageous.

When the closure member is dislodged from the suction throat (11), the primary water flow commences again through the entrance (3) and the closure member or ball (12) is sucked against the suction throat to interrupt the flow once more. Again, the auxiliary water flow along paths (24) and (26) is induced thus dislodging the ball. The flow interruption is thus periodic and abrupt with a relatively high frequency, and creates movement for the suction head to move over the surface to be cleaned.

The gap (19) and openings (25) are configured to minimise auxiliary water flow into, or out of, the tube when the ball is dislodged.

The skirt (21) operates as a debris trap to keep larger pieces of debris from blocking openings (25), and serves to allow greater flow with greater pump pressure and vice versa.

A variable auxiliary flow with pump pressure is desirable if wide variations in pump pressure are to be experienced. The distance of the release means from the suction throat must be selected for the desired effect. The effect of the auxiliary water flow can be varied by moving the release means (21) closer to, or further away from, the suction throat (11).

Figure 3:
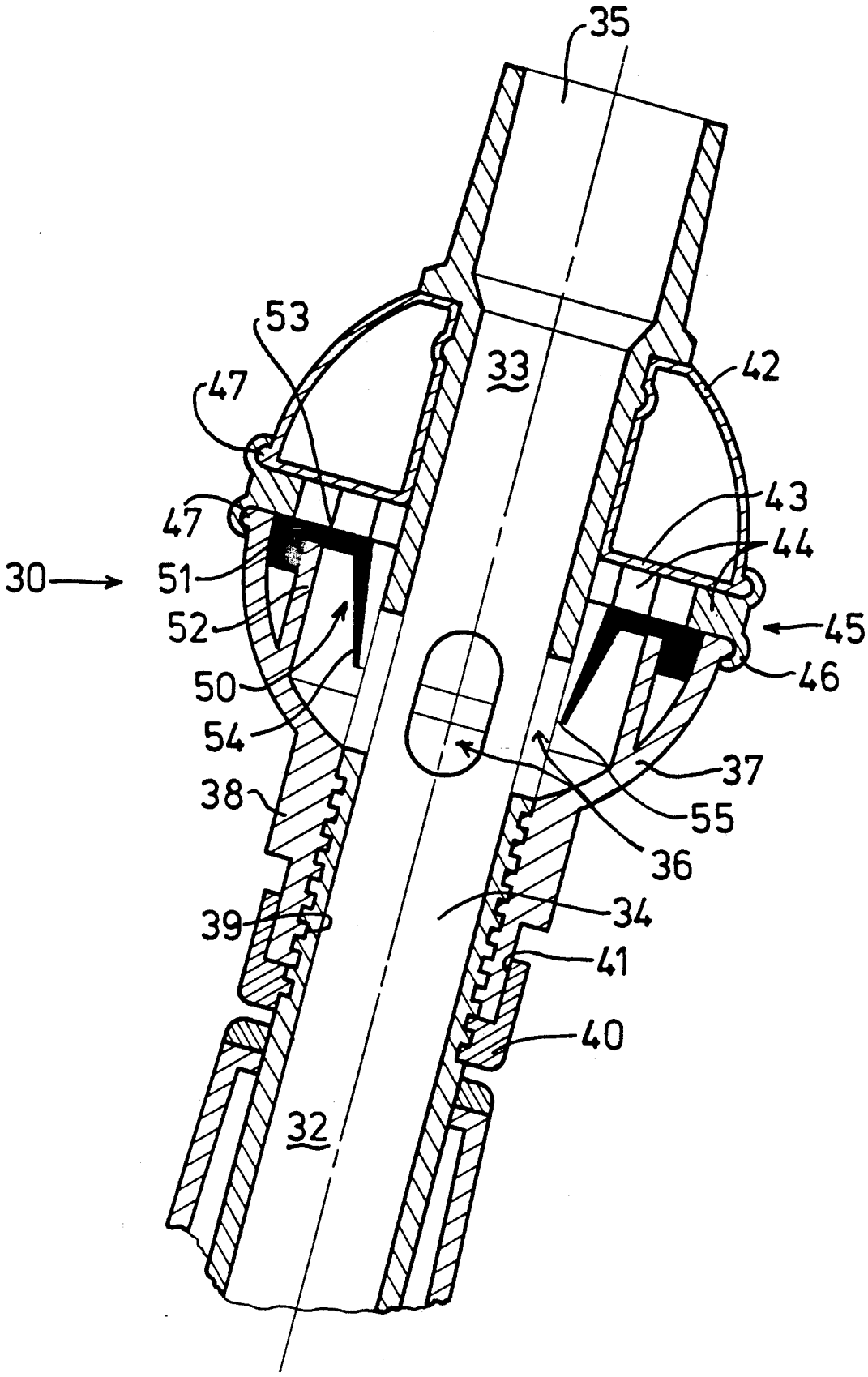
FIG. 3 is an enlarged cross-sectional view of an alternate embodiment of a release means to that of FIG. 2.

Referring to FIG. 3, an alternative embodiment of a release means (30) is connected to the end of a main flow tube (32), as described with reference to FIGS. 1 and 2. The release mechanism has a tube (33) located end to end and concentric with the main flow tube (32) at one end (34), and having a flared portion (35) at its other end for receiving a pool filter suction tube.

The release means tube (33) has four axially extending slots therein spaced equally around the circumference forming openings (36) for the auxiliary flow into the main tube. Surrounding the openings (36) is a hemispherical shell (37) which is concentric with the tube section (33) and forms a throat opening which faces away from the main flow tube (32).

The shell (37) is located on a threaded stem (38) which screws onto a threaded portion (39) of the tube end (32). A threaded collar (40) is located on the end of the tube (32) abutting the end of the stem (38). The collar has an internal rebate (41) which fits around the free end of the stem (38).

Opposite the shell (37) is another hemispherical shell (42) which an integral disc (43) extending diametrically across the shell opening to blind off the interior of the shell. The blind shell is spaced apart from the throat shell (37) by spacer blocks (44) spaced apart around the circumference to leave openings therebetween allowing a passage between the two shells into the throat, and through the openings (36) in the tube portion (33).

The blocks (44) are carried on a resilient ring (45) which has annular rebates (46), on each side of the blocks. The rebates clip over radially extending annular ridges (47) carried at the outer ends of each of the shell (37) and (42).

Located within the throat shell (37) is a skirt (50), which commences at its radially outermost portion with an annular block section (51) wedged in a space between the shell wall, and a wall (52) inside the shell, and which extends radially inwardly to form a disc portion (53). The opening in the middle of the disc has an axially extending tube (54) which is directed towards the head of the release mechanism in operative orientation. The portion (54) tapers from its initial widest position at the join with the disc portion (53), downwardly towards the tube wall and its free end (55). The disc portion (53) is located, in the direction towards the head, before opening the opening (36), and the free tube end (55) is located approximately midway along the length of the openings (36).

The spacer blocks (44) extend sufficiently radially inward to abut the block portion (51) of the skirt.

In use, the stem (38) and the collar (40) are screwed over the end of the main flow tube (32) to the full extent of the threading and the collar (40) is then turned backwards to act as a locking nut to hold the stem in position. These operations may be carried out by hand, thus obviating the necessity for tools.

The tube section (33) carrying the shell (42) is then screwed into the stem (38) to abut the end of the main flow tube (32). This is done with a ring (44) located between the two shells (37) and (42), so that the ridges (47) may clip into the rebates (46). The blocks (44) are slightly compressed providing a locking action of the shells together, to hold them during the vibratory motion of the apparatus in use.

The skirt (51) is held in position by the abutting blocks (44), in its location.

The apparatus operates in principle as described with reference to the embodiment of FIGS. 1 and 2. However, in this case the extent of the pressure of the main flow, when interrupted, forces the skirt (51) to flair radially outwardly and towards the head to expose more of the openings (36) to the auxiliary flow. This increases the auxiliary flow, and if the apparatus should jam totally, the skirt opens to its fullest extent to allow a substantial flow of water through the auxiliary path and up the main tube (33), to prevent the pool filter from operating under stress.

The stronger the suction of the pump, the more the skirt will open. Conversely, with a weak suction from the pool filter, the skirt closes off the opening (36) to a greater extent, and thus prevents short circuiting of the main flow by auxiliary flow through the release means, and into the pool pump suction line.

It has been found in practice that the device works to good effect in increasing the pressure range of pool filter pumps with which the cleaning apparatus may be used. The cleaning apparatus operates with pool filter pumps from a relatively low to a relatively high pressure without ill effect.

The means of securing the release mechanism in the flow line is simple and effective, and can be carried out by hand. Dismantling can also be carried out by hand, and this assists in clearing debris and the like from the openings if necessary.

Figures 4, 5:
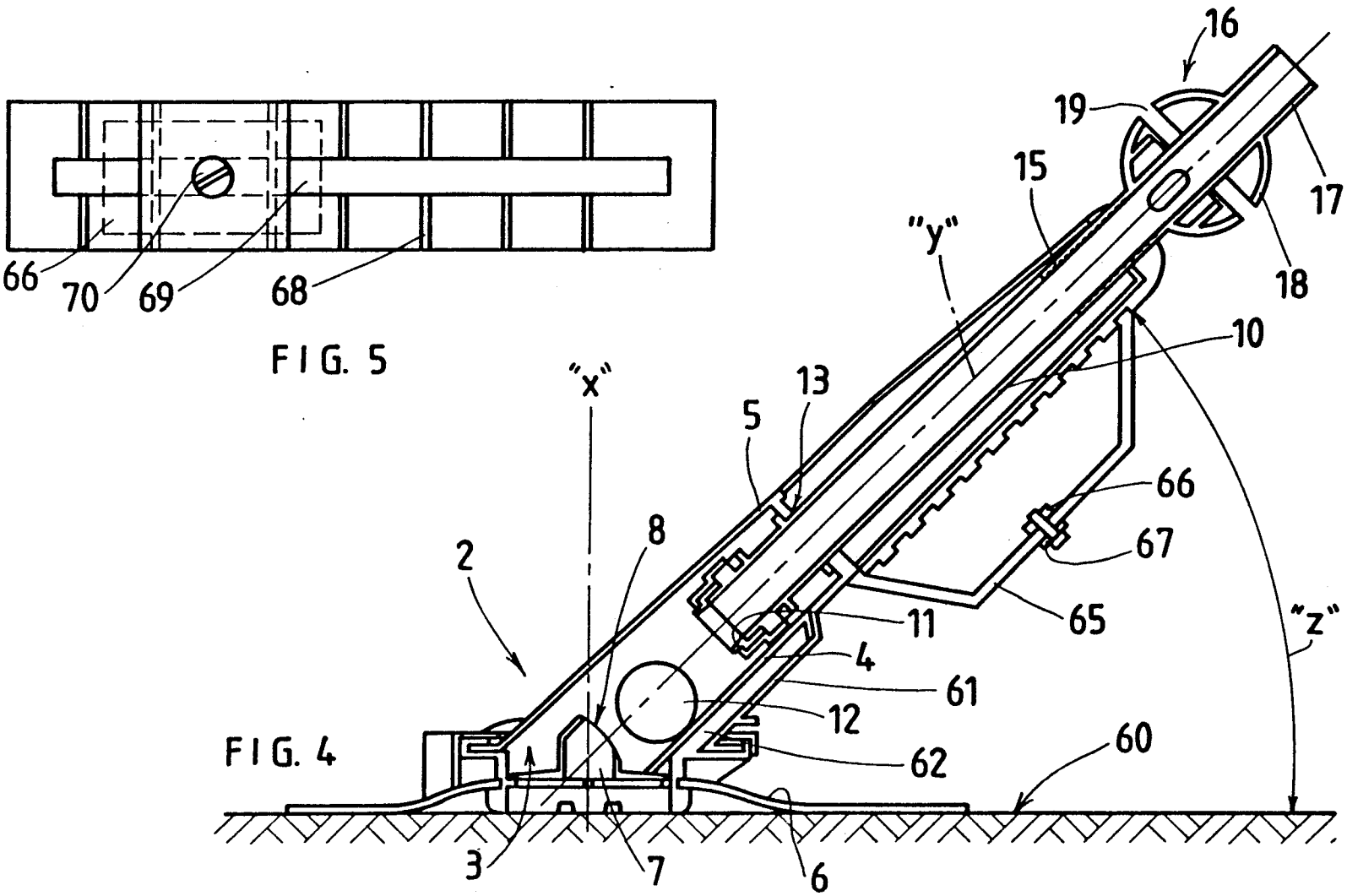
FIG. 4 is a sectional elevation of an apparatus for cleaning submerged surfaces fitted with balancing means according to the invention.
FIG. 5 is a plan view of an adjustable weight for the balancing means of FIG. 4.

Referring to FIGS. 4 and 5, a swimming pool cleaner is shown, which is substantially as described with reference to FIG. 1, with like numerals indicating like elements.

The suction head (2) operates on the plane of the surface (60) to be cleaned, and moves about an axis "X" normal to this plane. The tubular body (4) and suction tube (10) are co-axial on an axis "Y" which lies at a smallest angular distance "Z" from the plane of operation, or surface, (60).

On the tubular body (4), at its upper end (5), is a housing (61) for a main weight (62) for the apparatus. This weight serves to ensure that the apparatus has sufficient weight to sink to the bottom of a pool to be cleaned.

A slide (65) extends towards the release means (16), and is circumferentially positioned around the tube (10) to be the smallest angular distance "Z" from the surface plane (60). A weight (66) is selectively slidable along the slide (65) parallel to the tube axis.

Referring to FIG. 5, the adjustable weight (66) is rectangular in plan view and has a cap (67) on the opposite side thereof. This cap (67) engages in flutes (68) which form part of the upper portion of the slide.

Centrally located in the width of the cap (67) is a slot (69) which allows the adjustable weight to be secured in a number of positions by the threaded shank of a screw (70) passing through an aperture in the adjustable weight (67). In this way the weight (67) may be secured at any one of a number of positions along the length of the slide (65).

The adjustable weight functions to decrease the momentary stability of the apparatus on the surface (60) to be cleaned as it is moved further away from the suction head (2). It will be appreciated that the further the weight (67) is moved from the cleaning head, the more will it tend to lift the head off the surface (60).

The adjustable weight may be adjusted to compensate for suction drop in the flexible hose connecting the apparatus to the suction pump of a filtration system as this suction varies in accordance with the length of the hose. Furthermore, the weight may be used to compensate for varying pump strengths.

By using this adjustment the tendency of the apparatus to travel in a straight line can be adjusted therefore the random coverage of the pool can be controlled. Also the amount of time the apparatus spends on the floor of the pool as against the amount of time it spends cleaning the walls thereof may be determined. Furthermore the apparatus may be prevented from attempting to "climb out" of the pool.

What I/We claim as new and desire to secure by Letters Patent is:

1. Cleaning apparatus arranged to clean a submerged surface, comprising a suction head with a liquid entrance which is locatable against the surface, and which is in communication with a tube projecting away from the entrance with its free end connectable to a suction hose, the suction head also having a flow interrupter with a closure member movable between an interruption position and a release position to periodically and abruptly interrupt a primary liquid flow in use from the suction entrance through the tube to the hose, thereby to cause the suction head to move along the surface in suction communication therewith, and clean the surface, characterised in that:

a release means is located downstream of the closure member in the primary flow path of the tube, said release means has at least one liquid flow passage allowing an auxiliary liquid flow into the tube when the closure member in the interruption position interrupts the primary liquid flow, the flow passage being shaped to direct such auxiliary liquid flow in use to cause a force to operate on the closure member to thereby dislodge and move said closure member to the release position and allow the primary liquid flow.

2. Apparatus as claimed in claim 1 characterised in that the cross sectional flow area of the auxiliary flow passage and the primary liquid flow passage, together with the shaping of the auxiliary flow passage, are balanced to prevent excessive liquid flow through the auxiliary flow passage when the primary liquid flow occurs in use.

3. Apparatus as claimed in claim 2 characterised in that openings for the auxiliary flow have a flow control means which is movable from a rest position in response to increasing auxiliary flow pressure, to increase the cross sectional area of the auxiliary flow path into the auxiliary flow openings, and which is movable to return to the rest position with decrease in auxiliary flow pressure.

4. Apparatus as claimed in claim 1 characterised in that liquid flow openings are provided for the auxiliary flow into the tube, the openings being provided with a flow control means which is movable from a rest position in response to increasing auxiliary flow pressure, to increase the cross sectional area of the auxiliary flow openings, and which is movable to return to the rest position with decrease in auxiliary flow pressure.

5. Apparatus as claimed in claim 4 characterised in that the release means is located around the tube, and includes a throat wall around auxiliary flow openings in the tube, the wall defining an annular throat leading into the auxiliary flow openings in the tube.

6. Apparatus as claimed in claim 5 characterised in that the auxiliary flow openings in the tube are formed by four axially extending slots spaced equally around the circumference of the tube.

7. Apparatus as claimed in claim 6 characterised in that the flow control means is a resilient skirt extending in operative location radially inwardly from the throat wall, across the throat opening, and extending further axially around the tube towards the head.

8. Apparatus as claimed in claim 5 characterised in that the flow control means is a resilient skirt extending in operative location radially inwardly from the throat wall, across the throat opening, and extending further axially around the tube towards the head.

9. Apparatus as claimed in claim 8 characterised in that the axially directed portion forms a skirt which tapers from a widest position removed from the tube wall and spaced from the tube openings, to a narrower free end position in which the free end of the skirt is around the tube openings and adjacent the tube walls.

10. Apparatus as claimed in claim 4 characterised in that the throat wall has a concentric tubular stem threadedly engagable around a complementarily threaded end of the main flow tube from the cleaning head, which stem is securable by means of a threaded collar acting as a lock nut at the end of the stem.

11. Apparatus as claimed in claim 10 characterised in that a tube section passing through the release means and carrying the auxiliary flow openings, is threadedly securable within the tubular stem to be concentric with the main flow tube.

12. Apparatus as claimed in claim 11 characterised in that the said release means tube section carries a blind throat portion which is complementarily shaped to the throat portion leading to the tube openings, and which is spaced apart from the throat wall by spacer blocks.

13. Apparatus as claimed in claim 12 characterised in that the spacer blocks are spaced apart around the circumference of the abutting throat wall and blind throat portions, leaving openings in between spacer blocks which communicate with the throat.

14. Apparatus as claimed in claim 13 characterised in that the blocks are carried on a ring which is resilient and has radial formations clippable onto complementary radial formations around the outside of the throat wall and the blind throat portion.

15. Apparatus as claimed in claim 14 characterised in that the blocks are of resilient material, selected to provide a locking action under compression when the threaded parts are connected.

16. Apparatus as claimed in claim 1 characterised in that the auxiliary flow passage is dimensioned and shaped to allow the auxiliary flow in use to abruptly dislodge the closure member in use, and cause the closure member to move away from its interruption position and strike a rebound surface in the suction head.

17. Apparatus as claimed in claim 16 characterised in that the closure member is a ball which is movable to seat in the interruption position against a round throat in the suction entrance to thereby interrupt the primary liquid flow.

18. Apparatus as claimed in claim 17 characterised in that the rebound surface is located in the liquid flow path opposite the throat.

19. Apparatus as claimed in claim 18 characterised in that the rebound surface is shaped to direct the ball back to the throat surface after the ball has struck it.

20. Apparatus as claimed in claim 19 characterised in that the rebound surface has a convex shape.

21. Apparatus as claimed in claim 19 characterised in that the rebound surface has a flat shape.

22. Apparatus as claimed in claim 1 characterised in that the tube extends into the suction head to be axially rotatable in a sealed mounting where it enters the suction head.

23. Apparatus as claimed in claim 1 characterised in that an adjustable weight is locatable in selectable positions between the suction head and the free tube end and is spaced from the plane of operation of the suction head against the surface in use.

24. Apparatus as claimed in claim 23 characterised in that the adjustable weight is located on that side of the body which has generally the smallest angular distance from the operative plane of the suction head and hence the surface to be cleaned in use.

25. Apparatus as claimed in claim 24 characterised in that the adjustable weight is slidable along a path in at least one guide and includes securing means for securing it in association with the tube and suction head.

26. Apparatus as claimed in claim 25 characterised in that the securing means is a screw extending through the weight to be engagable with one of a plurality of flutes located along the path at spaced intervals.

* * * * *